United States Patent [19]

Walter

[11] 4,186,848

[45] Feb. 5, 1980

[54] BASE TYPE DISPENSER FOR BOTTLE-LIKE CONTAINER WITH COLLAPSIBLE DISPENSING AND VENT LINES

[75] Inventor: John Walter, Evergreen Park, Ill.

[73] Assignee: The Continental Group, Inc., New York, N.Y.

[21] Appl. No.: 956,163

[22] Filed: Oct. 31, 1978

[51] Int. Cl.[2] ..... B67D 5/12

[52] U.S. Cl. ..... 222/23; 222/184; 222/214

[58] Field of Search ..... 222/184, 23, 185, 214, 222/77, 481.5, 41, 49, 50, 212, 529, 479, 484; 251/7, 9, 10

[56] References Cited

U.S. PATENT DOCUMENTS

| | | | |
|---|---|---|---|
| 2,264,671 | 12/1941 | Kocher | 222/481.5 |
| 2,549,207 | 4/1951 | Kestenbaum | 222/77 X |
| 2,796,228 | 6/1957 | Kelly | 251/9 X |

*Primary Examiner*—Stanley H. Tollberg
*Attorney, Agent, or Firm*—Charles E. Brown

[57] ABSTRACT

This invention relates to a dispenser which is particularly adapted for receiving large size beverage containers for the purpose of dispensing partial quantities thereof. The dispenser includes a spigot which is of a simulated construction and generally corresponds to soda fountain dispenser spigots of the past. Dispensing is by way of dispensing and vent lines which include collapsible tube portions which are selectively clamped closed or are permitted to open by means of a handle member of the spigot. The dispenser may have incorporated therein a scale which is operable by the weight of the container and beverage contained therein to indicate the amount of beverage remaining in the container when the beverage cannot be visually inspected.

16 Claims, 8 Drawing Figures

FIG.3
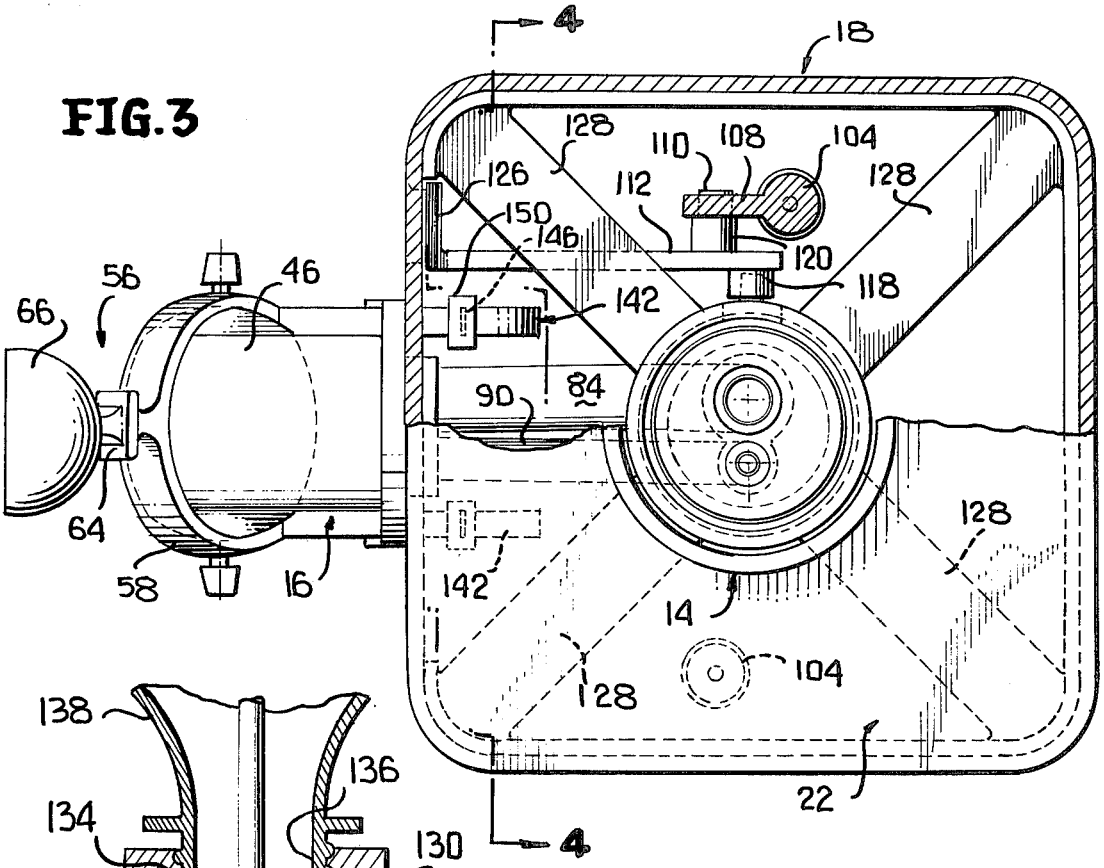
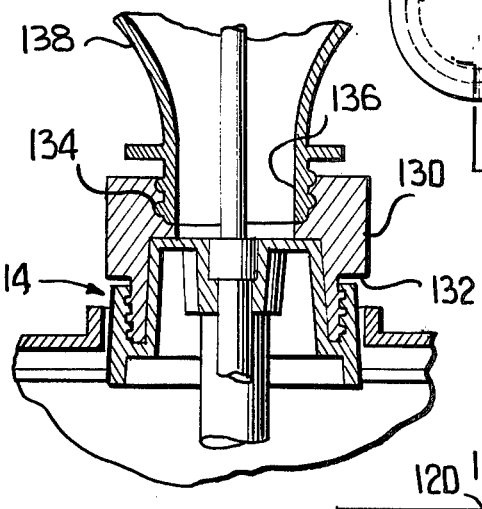
FIG.5
FIG.4
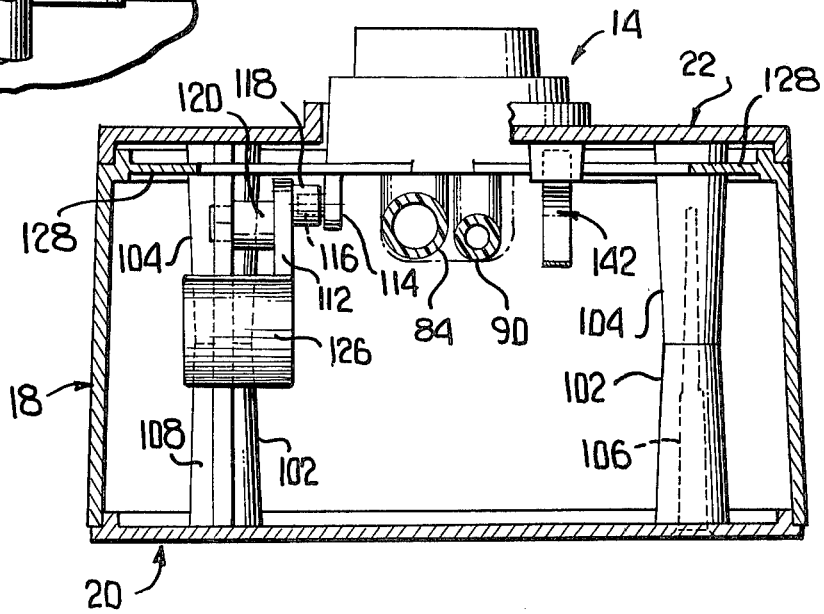

BASE TYPE DISPENSER FOR BOTTLE-LIKE CONTAINER WITH COLLAPSIBLE DISPENSING AND VENT LINES

This invention relates in general to new and useful improvements in dispensers for liquids, and most particularly to a dispenser which is adapted to have mounted thereon a liquid product container for dispensing the contents of the container.

This invention is most particularly adapted to dispense carbonated beverages which are sold in containers containing more than one serving quantities, and includes a simulated dispensing spout which has incorporated therein a dispensing tube and a vent tube which open into a container when attached to the dispenser. The simulated spigot is provided with clamp means for normally clamping closed both the dispensing tube and the vent tube and being shiftable to a position allowing the tube, which is of a resilient construction, to self-open, thereby to permit the gravity dispensing of the liquid product from the associated container.

The simulated spigot of the dispenser is provided with over-center spring means which automatically function to hold a handle member of the sigot in a selected one of a shutoff position and a dispensing position.

The vent tube is part of a vent line which includes a tube portion that extends from the dispenser a sufficient height so as to be disposed above the level of the carbonated beverage within the container, whereby incoming vent air passes through the beverage without coming into direct contact therewith so as not to reduce the carbonization of the beverage as a portion of the beverage is dispensed, thereby maintaining the carbonization of the beverage at a substantially constant level throughout the dispensing of the entire contents of the container.

The dispenser is provided with a fitment portion which generally corresponds to the configuration of the usual screw type closure cap for the beverage container, and thus a seal corresponding to the original seal for the container is maintained between the dispenser and the container.

Another feature of the dispenser is that it may be conveniently utilized with containers which are of a construction wherein the level of the beverage within the container is not visible. To this end the dispenser is provided with a scale that carries the fitment for the sealing of the container to the dispenser with the scale being actuated by the weight of the container and the beverage contained therein. In this embodiment of the invention the fitment is mounted for vertical movement relative to the remainder of the dispenser and becomes part of the scale.

With the above and other objects in view that will hereinafter appear, the nature of the invention will be more clearly understood by reference to the following detailed description, the appended claims, and the several views illustrated in the accompanying drawings.

IN THE DRAWINGS

FIG. 3 is a plan view of the dispenser, with the container eliminated and parts of the dispenser base broken away.

FIG. 4 is an enlarged fragmentary transverse vertical sectional view taken generally along the line 4—4 of FIG. 3.

FIG. 5 is an enlarged fragmentary sectional view taken through the fitment of the dispenser, showing an adapter in place and a smaller neck finish container mounted on the adapter.

Figure 8:
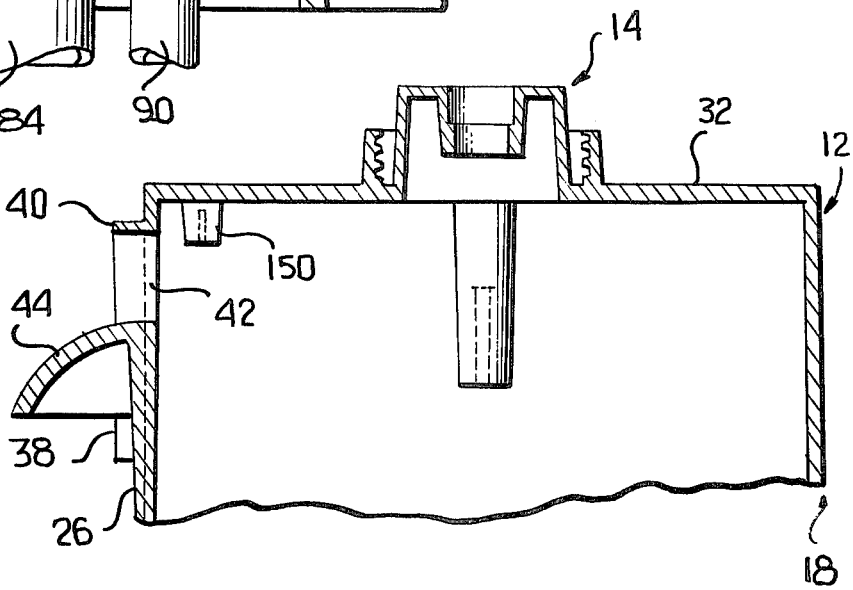

FIG. 8 is a fragmentary vertical sectional view taken through a modified form of base construction. Referring now to the drawings in detail, it will be seen that the dispenser, which is the subject of this invention, is generally identified by the numeral 10. The dispenser 10 includes a base 12 which carries a fitment 14 and a simulated spigot 16.

Figure 2:
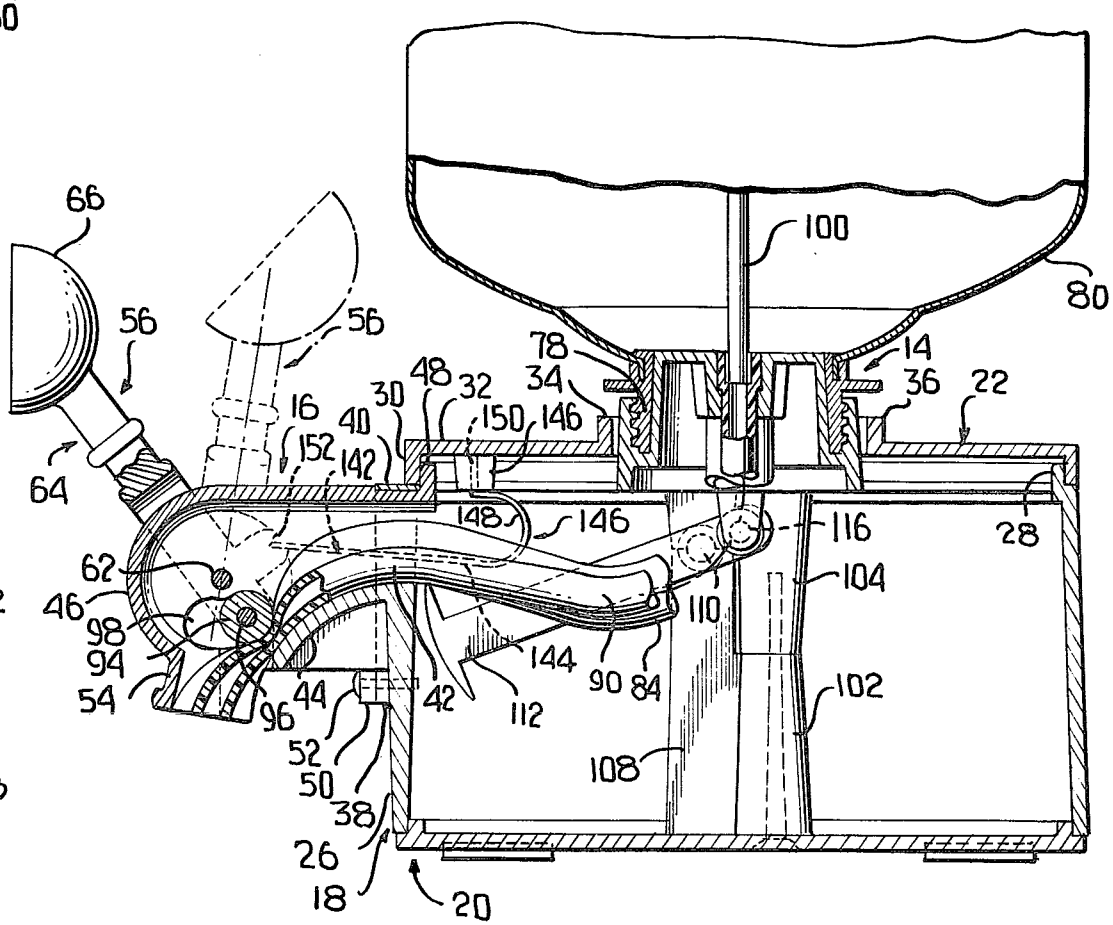
FIG. 2 is an enlarged fragmentary vertical sectional view taken generally along the line 2—2 of FIG. 1, and shows the details of the actuating mechanism of the dispenser.

The base 12 is of a three-piece construction and includes an intermediate base member 18 having the lower end closed by a bottom base member 20 and the upper end closed by a top base member 22, as is best shown in FIG. 2.

Figure 6:
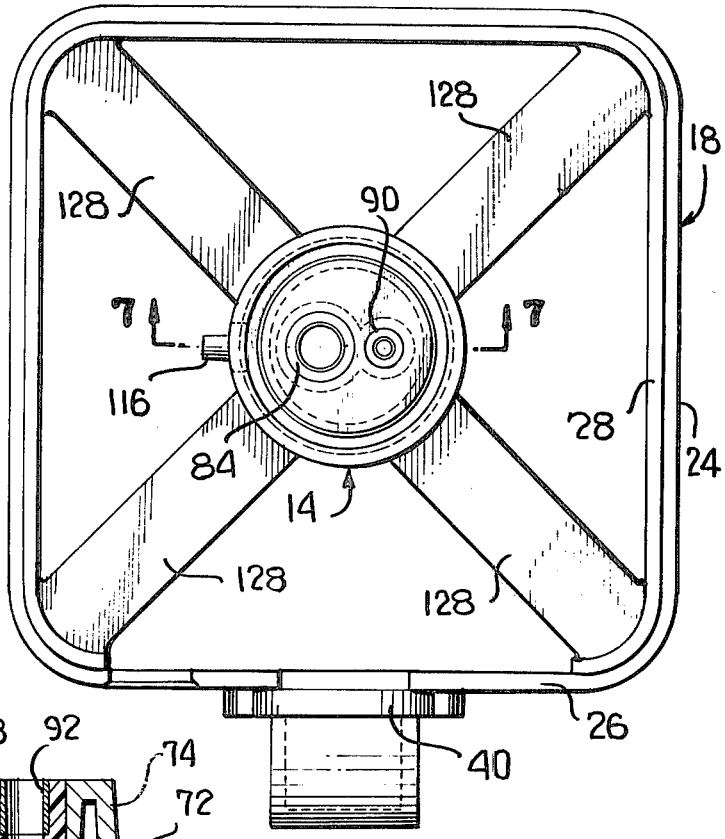
FIG. 6 is a plan view of the main portion of the base, and shows the specific mounting of the fitment and the means for attaching the spigot.

Referring specifically to FIGS. 2, 4 and 6, it will be seen that the base member 18 includes a generally rectangular body 24 including a front wall 26. The upper edge of the body 24 has an inwardly offset upstanding flange 28 extending therearound except for limited portions of the front wall 26. The flange 28 is offset to receive a depending flange 30 (FIG. 2) of the top member 22 which is integrally formed with a top panel 32. The top panel 32 has a central opening 34 defined by an upstanding flange 36.

Returning to FIGS. 2 and 6, it will be seen that the front wall 26 has a central portion thereof molded to define a mounting flange 38 which is particularly configurated to facilitate the mounting of the spigot 16. The mounting flange 38 includes an arcuate upper flange element 40 and, generally in alignment with the flange member 40, the front wall 26 has an opening 42 therethrough. At the underside of the opening 42 there is an integrally formed backup member 44 which is arcuate in cross section as is clearly shown in FIG. 2.

The spigot 16, which is in its overall appearance configurated to simulate a soda fountain spigot of the past, includes a simulated spigot body 46 which is constructed to telescope over the backup member 46 and interlock beneath and behind the flange 40. The spigot body 46 is of an inverted U-shaped cross section and has at the rear top thereof an upstanding flange 48 which is received within the opening 42 and then locked behind the flange 30. The spigot body 46 further includes mounting ears 50 at the lower rear corners thereof through which fasteners 52 pass into the front wall 26 rigidly to secure the spigot body 46 on and as a continuation of the mounting flange 38.

The lower forward part of the spigot body 46 is of a configuration to define a simulated spout 54 which is spaced from the backup member 44 in a forward direction.

Figure 1:
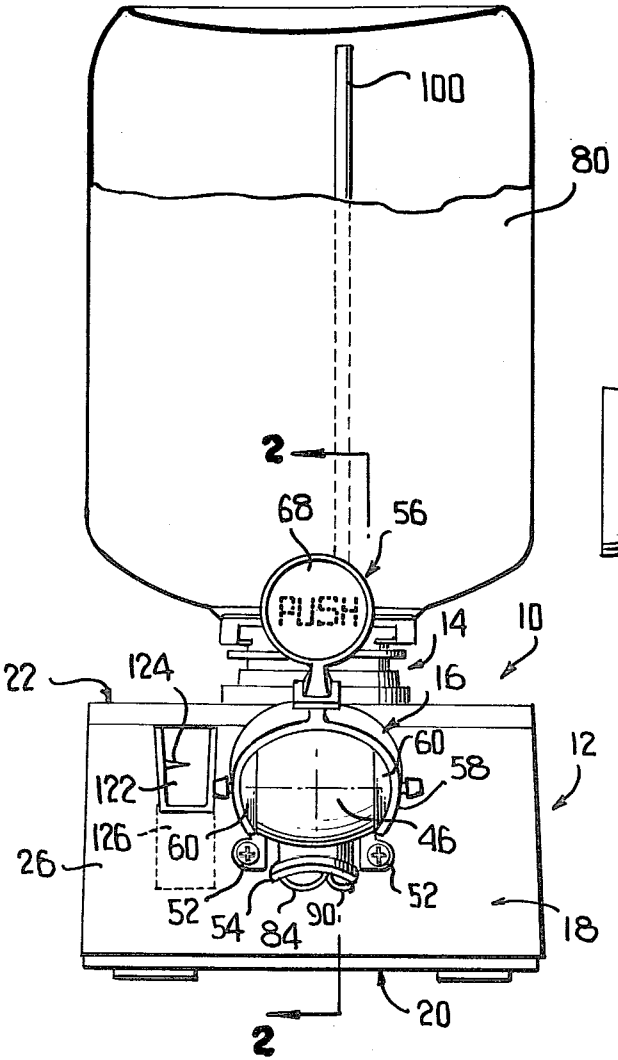
FIG. 1 is a front elevational view of the dispenser with a container attached, and an upper part of the container broken away.

The simulated spigot 16 also includes a handle member, generally identified by the numeral 56. As is best shown in FIG. 1, the handle member 56 includes a generally U-shaped mounting portion 58 which carries a pair of cup-like washers 60 which rotate on the outer surface of the spigot body 46. A pivot pin 62 extends through the U-shaped mounting portion 58 and the spigot body 46 pivotally to mount the handle member 56.

The handle member 56 includes a stem 64 which extends upwardly from the mounting portion 58. The stem 64 terminates in a grip member 66 which is provided with a suitable instruction-bearing insert 68 identifying the manner of operation.

Figure 7:
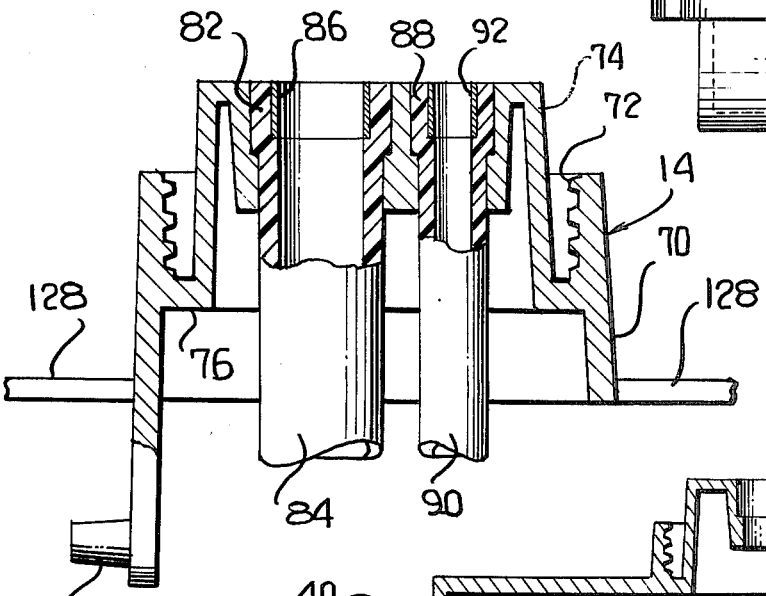
FIG. 7 is an enlarged fragmentary vertical sectional view taken generally along the line 7—7 of FIG. 6, and showing specifically the details of the fitment and the attachment of the dispensing and vent lines thereof.

In order to understand the function of the spigot 16, further description of the fitment 14 is necessary. As is best shown in FIGS. 2 and 7, the fitment 14 includes a tubular outer portion 70 which terminates at the upper portion thereof in internal threads 72. The outer portion 70 carries a plug 74 which is integrally connected to the outer portion 70 by a flange 76. It will be seen that the plug 74 and the outer portion 70 are so configurated as to be engageable in sealed relation to the neck finish 78 of a conventional container 80 which is preferably a container for a carbonated beverage, although other types of containers for liquids may be utilized in conjunction with the dispenser.

In order that the contents of the container 80 may be dispensed, the plug 74 has a stepped bore 82 therethrough in which one end of a dispensing line or tube 84 is fixedly secured by means of a lock ring 86. The dispensing tube 84 extends down into the interior of the base 12 and is gently bent in opposite directions so as to pass through the opening 42 and then down between the simulated spigot 54 and the backup member 44, as is clearly shown in FIG. 2.

The plug 74 also has a vent opening 88 of a stepped construction with there being secured in the vent opening 88 a vent line or tube 90 by means of a locking ring 92. The vent line 90 also extends down into the base 12 and is gently bent so as to extend through the opening 42 and then down between the simulated spout 54 and the backup 44. It will be seen from FIG. 2 that the dispensing tube 84 and the vent tube 90 have their ends terminating generally within the simulated spout and in concealed relation.

Returning now to the handle member 56, it will be seen that it carries a roller 94 which is rotatably journalled on a transverse pin 96 which is carried by the mounting bracket or portion 58. The upper ends of the roller 94 are concealed by the washers 60 with the roller being of a sufficient length to extend through a slot 98 in each side of the spigot body 46. The ends of the slots 98 define the stroke of the roller 94 as the handle member 56 is shifted between a dispensing position and a closed position.

It will be seen from FIG. 2 that when the handle member 56 is in its closed position, the roller 94 has been pivoted about the axis of the pin 62 in a direction opposite to the flow of liquid through the dispensing tube 84 to a position in cooperation with the backup member 44 to clamp close both the dispensing tube 84 and the vent tube 90.

When the handle member 56 is shifted to the dotted line dispensing position of FIG. 2, the roller 94 swings to the left, allowing sufficient space between the roller and the backup member 44 for the resilient dispensing tube 84 and vent tube 90 to open.

At this time it is pointed out that the vent line or tube 90 is provided with an extension tube 100. The extension tube 100 will be of a length in accordance with the height of the container 80 so that it will extend through the liquid in the container into the void space above the level of the liquid even when the container is in its filled condition. This is best shown in FIG. 1.

It is pointed out here that it is highly desirable that the extension tube 100 be of a length so as to prevent incoming air from bubbling through the liquid. Not only does this provide for the proper vending of the container, but in the case of carbonated beverages prevents the incoming air from absorbing the carbon dioxide within the liquid and thus does not reduce the carbonization of the liquid stored within the container 80 as the liquid is progressively dispensed from the container.

At this time it is pointed out that the bottom member 20 and the top member 22 have cooperating posts 102 and 104, as is best shown in FIG. 4, which are secured together by elongated fasteners 106. The intermediate member 18 is thus clamped between the bottom member 20 and the top member 22. In the preferred embodiment of FIGS. 1–7, one pair of posts 102, 104 may be provided with an offset rib 108 which defines a bearing for a journal 110 of a scale lever 112. The fitment 14 also has a base portion 114 which carries a pivot pin 116 for the scale lever 112. The scale lever 112 is provided with offset sockets 118 and 120 which are engaged over the pivot pins 116 and 110, respectively, and due to the offset relationship of the pivot pins 110, 116, vertical movement of the fitment 14 with respect to the base 12 will result in the pivoting of the pivot lever 112. The mounting of the fitment 14 for vertical movement will be described hereinafter.

As shown in FIG. 1, the front wall 26 is provided with an indicator opening 112 with a half full pointer 124. The forward end of the scale lever 116 is provided with an indicator 126 which is aligned with the opening 122. When the container 80 is in place, but empty, the upper edge of the indicator 126 will be aligned with the lower edge of the opening 122, and when the container 80 is filled, the indicator 126 will completely close the opening 122 to indicate a full condition.

Referring now to FIG. 6, it will be seen that the fitment 14 is formed integrally with the intermediate member 18 and is connected to the walls thereof at the corners and at the top part by integral straps 128. It is to be understood that the intermediate member 18 will be molded of a suitable material which will have sufficient flexibility in the thin straps 128 so as to permit the fitment 14 to descend vertically under the weight of the container and the liquid contents thereof, if any. It is also pointed out at this time that the curvature and flexibility of the dispensing tube 84 and the vent tube 90 is such as not to in any way hinder or resist the vertical movement of the fitment 14.

At this time it is pointed out that the dispenser 10 is intended to dispense the contents of containers of different sizes and different neck finishes. To this end there is provides a suitable adapter 130 which has a lower portion 132 configurated for sealing threaded engagement with the fitment 14 in the same manner as the neck finish 78 of the container 80. The upper portion of the adapter 130 is provided with an internal configuration 134 for threaded sealing engagement with the neck finish 136 of a modified type of container 138.

At this time it is also pointed out that suitable overcenter spring means 140 are provided for holding the handle member 56 in both the dispensing position and the closed position. The spring means includes a pair of leaf springs 142 which have elongated flat portions 144 joined to an anchoring portion 146 by a generally U-shaped bend 148. The anchoring ends 146 are received in slots in lugs 150 depending from the top member 22 while the straight portions 144 extend through openings in the front wall 26. The forward ends of the elongated flat portions 144 are received in notched projections 152 extending rearwardly from opposite sides of the mounting portion 58 of the handle member 56 generally in alignment with the pivot pin 62. When the handle member 56 is in its closed position, the flat portions 144 are flexed upwardly as shown in FIG. 2. When the handle member 56 is moved to its dispensing position, the leaf springs 142 are flexed to an over-center position and the flat portions 144 are flexed downwardly. Thus, the leaf springs 142 serve, in conjunction with the engagement of the roller 94 in the opposite ends of the slots 98, to lock the handle member 56 in a selected one of its two positions.

When it is not desired to provide the dispenser 10 with a scale, the base 12 may be of a modified construction so that the top member 22 and intermediate member 18 may be molded of a one-piece construction and with the fitment 14 being integrally formed with the top panel 32, as is clearly shown in FIG. 8. No other changes are required except, of course, for the elimination of the scale lever 112, the means pivotally mounting the scale lever, and the indicator opening 122.

Although only two preferred embodiments of the dispenser have been specifically illustrated and described herein, it is to be understood that minor variations may be made in the dispenser construction without departing from the spirit and scope of the invention as defined by the appended claims.

I claim:

1. A dispenser for controllably dispensing a liquid from a product container, said dispenser comprising a base having an upper portion, a fitment carried by said base upper portion in an upstanding position for attaching an end fitment of an inverted product container to said base in sealed engagement with said fitment, a dispensing line and a vent line extending through said fitment for constant communication with the interior of an attached product container, a simulated spigot carried by said base remote from said fitment, said vent line and said dispensing line each having a collapsible tube portion extending from said fitment into said spigot and terminating thereat, said spigot including a fixed backup member and a movable handle member carrying a clamping member cooperable with said backup member normally to collapse said tube portions to prevent both dispensing and venting.

2. A dispenser according to claim 1 wherein said simulated spigot includes a simulated spout, and at least said dispensing line tube being seated within said simulated spout.

3. A dispenser for controllably dispensing a liquid from a product container, said dispenser comprising a base having an upper portion, a fitment carried by said base upper portion for attaching a product container to said base in sealed engagement, a dispensing line and a vent line extending through said fitment for communication with the interior of an attached product container, a simulated spigot carried by said base, said vent line and said dispensing line each having a collapsible tube portion extending into said spigot and terminating thereat, said spigot including a fixed backup member and a movable handle member carrying a clamping member cooperable with said backup member normally to collapse said tube portions to prevent both dispensing and venting, overcenter spring means engaging said handle member for holding said handle member in a selected one of tube clamping and tube releasing positions.

4. A dispenser according to claim 3 wherein said spring means includes a leaf spring and said handle member includes a fitting receiving a free end of said leaf spring, said fitting changing the angular position of said leaf spring when said handle member is shifted between its tube clamping and tube releasing positions and effecting bowing of said leaf spring in opposite directions.

5. A dispenser for controllably dispensing a liquid from a product container, said dispenser comprising a base having an upper portion, a fitment carried by said base upper portion for attaching a product container to said base in sealed engagement, a dispensing line and a vent line extending through said fitment for communication with the interior of an attached product container, a simulated spigot carried by said base, said vent line and said dispensing line each having a collapsible tube portion extending into said spigot and terminating thereat, said spigot including a fixed backup member and a movable handle member carrying a clamping member cooperable with said backup member normally to collapse said tube portions to prevent both dispensing and venting, said spigot including an inverted generally U-shaped cross-sectional portion extending from said base, said backup member closing an under part of said U-shaped cross-sectional portion and combining therewith to define a protected passageway for said vent line and dispensing line collapsible tube portions.

6. A dispenser for controllably dispensing a liquid from a product container, said dispenser comprising a base having an upper portion, a fitment carried by said base upper portion for attaching a product container to said base in sealed engagement, a dispensing line and a vent line extending through said fitment for communication with the interior of an attached product container, a simulated spigot carried by said base, said vent line and said dispensing line each having a collapsible tube portion extending into said spigot and terminating thereat, said spigot including a fixed backup member and a movable handle member carrying a clamping member cooperable with said backup member normally to collapse said tube portions to prevent both dispensing and venting, said clamping member being in the form of a roller for simultaneously closing said tube portions and forcing drainage of said dispensing line tube portions.

7. A dispenser according to claim 6 wherein the movement of said roller towards a closed position is opposite the direction of flow through said dispensing line.

8. A dispenser for controllably dispensing a liquid from a product container, said dispenser comprising a base having an upper portion, a fitment carried by said base upper portion for attaching a product container to said base in sealed engagement, a dispensing line and a vent line extending through said fitment for communication with the interior of an attached product container, a simulated spigot carried by said base, said vent line and said dispensing line each having a collapsible tube portion extending into said spigot and terminating thereat, said spigot including a fixed backup member and a movable handle member carrying a clamping member cooperable with said backup member normally to collapse said tube portions to prevent both dispensing and venting, said fitment including an outer portion having internal threads for threaded engagement with a container neck finish and an inner plug portion for reception within the interior of a container neck finish, said dispensing line and said vent lines terminating in said plug portion, and said vent line having a replaceable extension extending from said plug portion.

9. A dispenser according to claim 1 wherein said vent line fixedly extends above said fitment a distance selected in accordance with the intended product container to extend above the level of the liquid product within the container.

10. A dispenser for controllably dispensing a liquid from a product container, said dispenser comprising a base having an upper portion, a fitment carried by said base upper portion for attaching a product container to said base in sealed engagement, a dispensing line and a vent line extending through said fitment for communication with the interior of an attached product container, a simulated spigot carried by said base, said vent line and said dispensing line each having a collapsible tube portion extending into said spigot and terminating thereat, said spigot including a fixed backup member and a movable handle member carrying a clamping member cooperable with said backup member normally to collapse said tube portions to prevent both dispensing and venting, said fitment being formed separately from said base upper portion, resilient means carried by said base mounting said fitment for vertical movement, and indicator means responsive to said vertical movement connected to said fitment for indicating the amount of product remaining in a container to be dispensed.

11. A dispenser according to claim 10 wherein said resilient means includes a pair of crossing flexible support members having remote ends attached to said base and central portions attached to said fitment.

12. A dispenser according to claim 10 wherein said indicator means includes a lever, and spaced pivot means connecting said lever to said base and said fitment.

13. A dispenser according to claim 10 wherein said vent line and said dispensing line are flexible to permit freedom of vertical movement of said fitment relative to said base.

14. A dispenser comprising a base, a fitment for mounting a liquid containing container in sealed relation, dispensing means coupled to said fitment for receiving liquid from said fitment, said fitment being formed separately from said base, resilient means carried by said base mounting said fitment for vertical movement, and indicator means responsive to said vertical movement connected to said fitment for indicating the amount of product remaining in a container to be dispensed.

15. A dispenser according to claim 14 wherein said resilient means includes a pair of crossing flexible support members having remote ends attached to said base and central portions attached to said fitment.

16. A dispenser according to claim 14 wherein said indicator means includes a lever, a spaced pivot means connecting said lever to said base and said fitment.

* * * * *